US009014336B2

(12) United States Patent
Luerkens

(10) Patent No.: US 9,014,336 B2
(45) Date of Patent: Apr. 21, 2015

(54) POWER SUPPLY UNIT FOR AN X-RAY TUBE

(75) Inventor: Peter Luerkens, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 93 days.

(21) Appl. No.: 13/990,443

(22) PCT Filed: Dec. 5, 2011

(86) PCT No.: PCT/IB2011/055451

§ 371 (c)(1),
(2), (4) Date: May 30, 2013

(87) PCT Pub. No.: WO2012/080899

PCT Pub. Date: Jun. 21, 2012

(65) Prior Publication Data

US 2013/0251108 A1 Sep. 26, 2013

(30) Foreign Application Priority Data

Dec. 15, 2010 (EP) ..... 10195168

(51) Int. Cl.

| | |
|---|---|
| ***H05G 1/32*** | (2006.01) |
| ***H05G 1/10*** | (2006.01) |
| ***H05G 1/22*** | (2006.01) |
| ***H05G 1/58*** | (2006.01) |

(52) U.S. Cl.
CPC . *H05G 1/32* (2013.01); *H05G 1/10* (2013.01); *H05G 1/22* (2013.01); *H05G 1/58* (2013.01)

(58) Field of Classification Search
CPC ..... H05G 1/20; H05G 1/24; H05G 1/60; H05G 1/06; H01J 35/22
USPC ..... 378/106, 103, 107, 108, 110, 114
See application file for complete search history.

(56) References Cited

U.S. PATENT DOCUMENTS

| | | | | |
|---|---|---|---|---|
| 3,539,812 | A | | 11/1970 | Johnson |
| 4,093,859 | A | | 6/1978 | Davis et al. |
| 4,200,795 | A | * | 4/1980 | Kawamura et al. ..... 378/106 |
| 4,317,999 | A | * | 3/1982 | Amtmann et al. ..... 378/114 |
| 4,331,876 | A | * | 5/1982 | Amtmann et al. ..... 378/106 |
| 4,614,999 | A | * | 9/1986 | Onodera et al. ..... 363/28 |
| 4,654,770 | A | | 3/1987 | Santurtun et al. |
| 4,706,268 | A | * | 11/1987 | Onodera ..... 378/98.12 |
| 5,450,310 | A | | 9/1995 | Kawakami |
| 5,661,774 | A | | 8/1997 | Gordon et al. |
| 2010/0098217 | A1 | | 4/2010 | Caiafa et al. |

FOREIGN PATENT DOCUMENTS

| | | |
|---|---|---|
| EP | 0817546 | 1/1998 |
| WO | WO03103347 | 12/2003 |
| WO | WO2004001778 | 12/2003 |
| WO | WO2008026127 | 3/2008 |
| WO | WO2010015960 | 2/2010 |

* cited by examiner

*Primary Examiner* — Irakli Kiknadze

(57) ABSTRACT

A power supply unit for an X-ray radiation source (10) comprises a high voltage generator (4) for providing a basic current for the operation of an X-ray tube (10), a waveform generator (6) and a pulse transformer (2) for providing superposable voltage peaks and a control unit (8) for generating a counterbalance at an input (12) of the pulse transformer (2) to prevent saturation effects. Providing different reference waveform patterns lead to the prevention of overshooting and ringing.

16 Claims, 6 Drawing Sheets

POWER SUPPLY UNIT FOR AN X-RAY TUBE

FIELD OF THE INVENTION

The invention relates to a power supply unit for generating a high output voltage for supplying an X-ray source, e.g. an X-ray tube, and finds particular application to computer tomography (CT) applications, wherein the output voltage comprises at least two different high output voltage levels. Furthermore, the invention relates to an X-ray imaging system comprising an X-ray source, a detector and a power supply unit adapted to provide at least two different high output voltage levels. Still further, the invention relates to a method for generating different high output voltage levels.

BACKGROUND OF THE INVENTION

The spectral composition of X-rays provided by an X-ray tube depends on the acceleration voltage of the electron beam. The energy of the X-ray quantum increases with the accelerating voltage. Since all different sorts of tissues in a living body have different absorption properties depending on the energy of the X-rays impinging on the relevant tissue, this effect can be used to differentiate between different tissue compositions and thus allows more specific diagnosis of various pathological situations, e.g. tumors, kidney stones, or plaque deposition in blood vessels.

In computed tomography systems, an imaging apparatus is rotating around the body of interest, while new picture frames are taken after small angular displacements. Each frame is taken within a predefined time window which depends mainly on the resolution of the detector and rotational speed. By mechanical constraints and electronic complexity all time windows have the same duration during an individual examination. If several frames are taken at different energy levels, the type of tissue can be examined in addition to the general achievement of 3D pictures. For example, every other frame could be taken at a different energy level.

In order to achieve best separation between the spectra and an optimal image reconstruction, the supply voltage of the x-ray tube should be kept constant during the exposure time of the respective frame. If different energy levels are following short after each other, e.g. every other frame, it is also necessary to keep the transition between the different voltage levels as short as possible, or in case of examining a living human to prevent radiation from the x-ray tube during the transition. Radiation at intermediate levels deteriorates the image quality and imposes unused radiation dose on a patient and is generally not useful for achieving a high quality image.

The efficiency sensitivity to the CT system is much higher at higher electron beam energy and vice versa. Therefore by sufficient heating the emission current of the cathode has to be chosen high enough, that the low energy image frame is sampled at sufficient signal-to-noise ratio within a given time frame (e.g. 100 μs). The consequence is that an image taken at the higher acceleration voltage is prone to overexposure, due to the high sensitivity at higher voltage. In order to avoid this, the emission current has to be reduced again by reducing the heating. This process requires some tens to hundreds of milliseconds, which is obviously to slow for a frame-by-frame switching of the energy levels. Therefore this is typically achieved by shortening the exposure time at the higher voltage. While the exposure at low voltage extends over the full time window, the exposure at high voltage level covers only a fraction of it by switching the x-ray tube on and off with a grid-electrode within a few microseconds.

It is another requirement that the working pulse, i.e. the period with x-ray radiation and exposure of the detector, has to occur in the mid of the exposure time window, because of geometrical reasons, It is further a requirement to achieve most freedom of choice of the sequence of high-voltage to low-voltage frame captures, i.e. any combination of a number of frame registrations at one voltage may be followed by any other number of registrations at some other voltage, e.g. the ratio of frame captures at two voltage levels $V_n$ and $V_m$ equals a ratio of n:m, with n and m being integer numbers.

It is an additional requirement, that the predefined time window for capturing a single image frame can be adjusted from a minimum value, e.g. 100 μs, to longer values, e.g. 500 μs, e.g. when the rotating speed of the CT gantry is reduced.

It is also a requirement that the means for achieving a dual- or multi-spectrum x-ray beam are small, lightweight and efficient.

A rather simple method to cover the field of use with dual energy examination is to make a helical scan with one energy level first in one direction and then travel back the same path with another energy level. This method is known as "back-to-back-scanning". It is clearly apparent that there is a rather large time delay between these two scans in different directions, which may lead to a misregistration if the position of the body of interest or the organs has changed in between these two scanning steps.

It is known to apply different energy levels every full revolution, which method is known as "alternating scan". If the organ of interest is rapidly moving, e.g. in case of a heart, there may still be misregistrations with this scan method.

It is also known to control the high voltage supply for altering the accelerating voltage of the X-ray tube by modulating a high voltage generator, which may be done with a time constant in the order of one ms. In contrast to that, the time difference between subsequent frames at a high rotation rate can be as small as 100 μs, which cannot be produced by current generator concepts.

WO 2010/015960 A1 shows an X-ray system comprising a radiation source, a high voltage generator and a modulation wave generator generating a modulation voltage wave having non-zero amplitude, which is combined with and modulates the source voltage between at least two different voltages.

US20100098217A1 shows a method to boost the output voltage of a high voltage DC power source by reconfiguring a chain of capacitors from a parallel to a series connection by means of multitude of controlled switches and diodes. There, the voltage during the boost phase cannot be fully controlled anymore as the extra energy is solely withdrawn from the series connection of capacitors. Moreover, the circuit consists of a multitude of elements that have to be operated and controlled at a very high voltage level. After returning to the lower voltage level, recharging of partially discharged capacitors produce settling effects of the high DC voltage leading to deterioration of the spectral quality of the x-ray beam. While it is simply possible to extent registration at the lower voltage, this cannot be achieved at the higher voltage due to the discharge of the capacitors.

It is also known to build a high voltage source for an X-ray tube with a modulated voltage by connecting a high voltage DC-source in series with a pulse transformer. In the EP817546A1 an X-ray system capable of quickly varying energy levels is shown comprising several different configurations of at least one high-voltage DC source in series with at least one transformer, the latter being supplied by a waveform generator. The transformer is connected to a secondary capacitor in parallel to the winding and forms a resonant circuit. The waveform generator generates a periodical waveform of a frequency close to the resonance frequency of the resonant circuit. Although it is intended to supply the waveform generator with arbitrary waveforms, including square wave pulse-shaped, it must be noted, that the influence of the resonant circuit behavior does not permit achievement of square wave or other pulse waveforms with a flat top property.

Another problem is saturation of the transformer which will occur after short time, due to the DC-nature of the secondary current. This will happen also, if it is attempted to register several image frames at the same (higher or the lower) voltage. Then the maximum possible voltage integral of the transformer will be exceeded. If saturation occurs the desired output voltage can no longer be maintained.

SUMMARY OF THE INVENTION

Common systems to realize high voltage multi-level DC generators are limited in several aspects. Solutions with a simple series transformer, will suffer from saturation of the transformer; voltage waveform quality and flexibility are not sufficient.

In switched-capacitor configuration it will not be possible to maintain a constant output voltage at all at the higher level and settling effects will deteriorate the quality of the x-ray spectrum during switching.

A modulation of a common high voltage generator by control leads to a long transition time between different voltage levels and does not allow fast sequences with different voltage levels.

Therefore, there may be a need for a power supply unit that is able to supply different high output voltage levels for an X-ray tube with the ability to withstand high system speeds and the ability to provide a predefined arbitrary sequence of specific voltage levels for use in an X-ray tube without the danger of reaching a saturation of the transformer core.

This need may be met by a power supply unit according to the features of independent claim 1. Advantageous improvements may be gathered from the dependent claims.

According to a first aspect of the invention the power supply unit comprises a high voltage generator, a waveform generator, a pulse transformer, and a control unit, wherein the high voltage generator and the pulse transformer are connected in a serial connection and the waveform generator is adapted for feeding an amplified signal voltage to the pulse transformer.

The waveform generator is adapted for amplifying a signal at a signal input and to supply this amplified signal to primary windings of the pulse transformer. Such a waveform generator may be realized by means of an electronic circuit with power semiconductor components that may deliver voltages with a level of e.g. up to 400V. The waveform generator preferably has the properties of a voltage source.

The high voltage generator is adapted for providing a high source voltage which will be used for an application across an anode and a cathode of an X-ray tube in order to accelerate electrons from the cathode towards the anode and thus create X-rays. The high voltage may be realized as a direct current in the range of 50 kV to 150 kV, e.g. 110 kV or other voltage. The generated voltage may be chosen according to the required spectral characteristics of the X-rays, tailored to the intended use of the related X-ray imaging apparatus.

The pulse transformer is adapted for amplifying a voltage signal provided by a waveform generator or other means with a comparably low voltage and a desired pattern to a high voltage with a magnitude similar to the voltage of the high voltage generator and may preferably be optimized for transmitting rectangular electrical pulses. For optimizing the performance of such a transformer low values of leakage inductance and distributed capacitance, a high open-circuit inductance and also a low coupling capacitance are preferable. According to the invention, the pulse transformer supplies a transformed signal voltage in series with the high voltage generator, so that the output of the pulse transformer is superposed on the high output voltage of the high voltage generator and fed to the X-ray tube.

Thereby the voltage of the high voltage generator contains specific peaks caused by the pulse transformer in order to influence the spectrum of the X-rays generated by the X-ray tube. The voltage pattern at the pulse transformer contains phases of zero voltage where only the voltage of the high voltage DC source is effective at the tube, e.g. during the exposure at the voltage with the lower absolute magnitude, and phases which contain a working pulse, e.g. during which the exposure at the voltage with the higher absolute magnitude.

Leakage inductance and other parasitic effects, such as the distributed capacitance of the pulse transformer and other capacitances, such as the capacitance of the high voltage cable between the tube and the high voltage generator, or of the tube, or of other parts of the system, which are exposed to the desired pulse shaped high voltage will normally lead to overshoot and ringing effects at any time where tube voltage or current change. These effects are suppressed by insertion of periods of intermediate voltage levels in the waveform at any time where at least one of the tube quantities changes. The duration and level of the intermediate voltage level are determined in advance from the desired change of the quantity, current or voltage or both.

According to the invention, the control unit is adapted for creating an offset signal and for feeding this offset signal to the input of the waveform generator, wherein the offset signal is depending on the difference between the current in the primary windings and the current in the secondary windings of the pulse transformer, first assuming a turn ratio of 1:1 for simplicity. Any relevant difference of the two currents, typically in the order of less than 10%, would lead to saturation of the transformer, causing rapidly decreasing impedance, an abrupt increase in current draw, and drop of output voltage.

Initially, when the X-ray-tube is switched on, e.g. by means of grid-control, a cathode current of the tube will occur. The initial current rise in the secondary winding of the transformer will lead to an induced voltage across the secondary transformer terminals. This voltage also becomes apparent at the primary side. If the amplifier is made of a voltage source type, the initial secondary current commutates to the primary side, producing a primary current which has the magnitude of the secondary current. This is precisely the amount of current required for preventing saturation of the transformer. However, once the secondary current has become constant, there will not be an induced voltage anymore which may keep up the primary current against the influence of resistive losses in the winding so that the primary current will decay. This will produce a difference in currents on both, primary and secondary side and the transformer will consequently saturate. Subsequently the transformer has low impedance and any attempt to apply a primary voltage in the direction of the saturated flux would lead to an excessive current. By the control unit the input of the pulse transformer is now influenced to eliminate this current value difference, counterbalances the decay of the primary current draw by applying a differential voltage at the primary winding and therefore leads to the prevention of saturation and overcurrent of the pulse transformer. If the tube current is switched off again, the decay of the secondary current reflects in a related decay of the primary current again, so that the balance of primary and secondary current will also be maintained. In a zero current state, usually an active balancing is not necessary.

If the turn ratio is different from 1:1 it is necessary to correct the difference of the current values depending on the winding ratio of the pulse transformer. Therefore, the measured current of the secondary winding may be multiplied by the winding ratio, e.g. through a gain factor in the control unit, enabling an appropriate comparison of the winding states.

Altogether, this enables the power supply unit according to the invention to continuously provide different high output voltage levels during any given exposure. The power supply unit has the further ability to withstand sudden activations and deactivations of the X-ray tube due to the above described characteristics of the amplifier unit and the balancing function of the control unit regarding the magnetic saturation. Therefore, it allows medical examinations which are very sensitive to the type of tissue and improve medical diagnostics with a high level of accuracy and a clearly lower danger of a jammed output voltage and therefore misregistrations.

According to an exemplary embodiment, the control unit is realized as a PI controller or as a PID controller, which PID controller is a proportional-integral-derivative controller widely used in industrial control systems. The proportional part "P" depends on a present error value and is merely represented by a gain factor, wherein the integral part "I" depends on the accumulation of past error values and the derivative part "D" represents a prediction of future error values, based on the current rate of change of the error value. The weighted sum of these three components is used to adjust the offset value superposed to the signal input of the waveform generator. A PID controller is commonly one of the best possible controller architectures when a system has a rather dynamical behavior, since the three different blocks in the PID controller can independently be tuned and therefore may be fully adjusted to achieve the desired behavior of the control system.

In an exemplary embodiment, there is provided a reference pattern generator connected to the signal input of the waveform generator and providing a waveform with a desired pattern to the waveform generator. The reference pattern generator is preferably adapted for providing a pulse pattern with a limited set of predefined voltage values above and below zero, wherein the voltage-integral over one complete or an integer fraction of the frame time window equals in order to prevent the saturation of the pulse transformer after a certain period. Basically, the reference pattern generator is capable of producing a multilevel waveform according to a predetermined timing pattern and predetermined voltage levels. In addition, this property allows an infinite number of consecutive cycles of the same pattern, while the series of cycles can be interrupted at any time where the transformer magnetization has returned to zero, usually when a pattern cycle is complete. From then on, only the regular voltage of the conventional high voltage generator will be present at the tube. The pattern sequence can be restarted then at any desired time.

In an exemplary embodiment the reference pattern generator provides a pulse sequence with a first time interval and with at least one working pulse, producing the desired high voltage pulse, followed by at least one opposite demagnetizing pulse in order to eliminate the magnetization of the pulse transformer due to the working pulse, wherein the integral of the voltage curve over the first time interval equals zero. E.g., if the working pulse is of positive polarity, then the demagnetizing pulse would be of negative polarity with the same voltage time integral.

In an exemplary embodiment, the pulse sequence comprises a pre-magnetization pulse for bringing the magnetization to a value which is of opposite polarity as it would be due to the working pulse alone. E.g. if the working pulse is of positive polarity then the pre-magnetization pulse is a negative voltage pulse and may then be succeeded by at least one working pulse with a positive voltage.

Pre- and de-magnetizing pulses may be applied in conjunction. In this case it is preferred, that a pre-magnetizing pulse produces a magnetization which is opposite to the magnetization produced by a working pulse alone, and with approximately half of its magnitude. Then, after application of the working pulse, the resulting magnetization is in the same direction as with the working pulse alone, but only at half of the respective magnitude. Eventually, a de-magnetizing pulse, which is again in opposite polarity as the working pulse, resets the magnetization to zero again. The voltage-time integral of the pre-magnetizing and de-magnetizing pulse account together for the same quantity than the voltage time integral of the working pulse, but in opposite direction. By distributing the compensation of the magnetization of the working pulse on a pre-magnetizing and a demagnetizing pulse, the peak magnetization can be reduced by factor of two which allows a much smaller and lighter transformer.

According to an exemplary embodiment the magnetization pulse is realized as a positive voltage with a certain magnetization pulse length leading to the desired peak voltage output for a desired length, e.g. 20 μs.

In another aspect the detailed waveform of the waveform generator is chosen in consideration of the effects of the leakage inductance of the transformer and parasitic capacitance in the high voltage current part in combination with the switching of the tube and of the high voltage level. In order to achieve an operation with flat-top high voltage pulses, free of overshoot and ringing, also in case of switching the tube on and off by means of a grid, intermediate levels are inserted in the pattern waveforms in the proximity of the voltage or current transitions which result in an overshoot-free and ringing-free pulse behavior. The intermediate levels of the waveform generator are chosen such that system state transforms from one desired state exactly into another desired state, e.g. from a first tube current I1 at a first tube voltage V1 to a zero tube current I2 at second voltage V2, then from this state to another tube current I3 at a another tube voltage V3, and so on. Thereby each transition requires a minimum of one extra intermediate voltage pulse.

According to an exemplary embodiment the magnetization pulse is realized in form of at least two magnetization pulse steps with different voltage values. This leads to the desired pulse waveform, prevents the transformer from oscillation and therefore eliminates all ringing effects.

According to an exemplary embodiment, the waveform generator is adapted for providing at least a second magnetization voltage step with a voltage value different from the value of the first magnetization voltage. This enables the power supply unit to prevent oscillations, especially when a second magnetization voltage value succeeds a first magnetization voltage value at an intermediate level. This may lead to a second magnetization voltage step that has a voltage value between zero and the first magnetization voltage step or vice-versa as well as a second magnetization voltage step with another polarity than the first magnetization voltage step, depending on the certain dynamic behaviour of the electric circuit, this second magnetization voltage pulse and the timing thereof. The duration and level of the intermediate voltage level are determined in advance from the desired change of the quantity, current or voltage or both.

According to an exemplary embodiment the waveform generator is adapted for providing at least a second magnetization voltage step with a voltage value step and a duration depending on the resonant frequency and the characteristic impedance of a circuit with the power supply unit and an X-ray tube. Also, according to an exemplary embodiment the waveform generator is adapted to produce a demagnetization sequence comprising of at least one demagnetization voltage value step step depending on the resonant frequency and the characteristic impedance of a circuit with the power supply unit and an X-ray tube. As depicted in FIG. 7 later on, the system behaves like a resonant circuit during voltage or current transitions. Such a system has two independent states, which are the voltage at the resonant capacitor, which in this case is equal to the voltage at the tube, and the current in the resonant inductor which is equal to the secondary pulse transformer current. It is characterized by a resonant frequency ω and characteristic impedance Z. When the system is initially in static conditions, i.e. the system states are constant over time, and the input voltage is changed in a step-like manner, the system reacts with an oscillation of the system states, both voltage and current. If the system states are drawn in a plane with one axis being the voltage of the capacitor and the other axis being the current in the inductor times the characteristic impedance, the system state locus follows a left turn circle after a voltage step is applied through the pulse voltage source. The progression starts at the initial state, defined by initial voltage and current. The location of the center of the circle is defined by the difference between the initial system state and the imposed pulse from the voltage source. In FIG. 7, the system input is depicted at the resonant inductor, so it is only possible to apply a step transition of the input voltage while the input current will follow, which means that the effective input pulse, defining the circle radius, is determined by the difference of the input voltage during the pulse and the initial voltage of the capacitor. During progress of the system state along the perimeter of the circle, the system state adopts a sequence of voltage and current values. The voltage for the initial pulse has now to be chosen such, that the progression contains the system state with the desired target current and voltage. Once the system state has reached this locus, this desired voltage is applied at the input, which effectively results in circuit radius of zero, which means the system enters again a static behavior, without any oscillations.

By understanding and applying this principle the appropriate pulse levels and durations can now be determined in dependency of the desired targets of the system states. For clarity constant quantities, such as the initial voltage, or and the constant part of voltage of the high voltage generator are not considered. Instead the derivation of the required pulse length and levels is related to the dynamic changes only. In this sense one may consider an initial system state of zero voltage and zero current. For those familiar with the state of the art, it is easy to superpose the original constant quantities to the result. Assuming an initial static system a change of the system state is required resulting in a new system state with a current of I and voltage of V. In the real system these quantities refer to the change of the system state rather than an absolute value. In a first step a voltage level will be applied which produces after some time the desired change of current and voltage by following the circular track of the system locus. The required voltage for the initial pulse level can be calculated by the following formula:

$$\Delta V_p = \frac{1}{2}\left(V + \frac{Z^2 \cdot I^2}{V}\right)$$

This equation relates to a situation without damping. In case of damping the required voltage change must be adjusted somewhat. The duration of the pulse is obtained from the angle between the connections between the initial system state, the center of the circle and the final system state. It can be calculated according to:

$$\alpha_p = a\sin\left(\frac{Z \cdot I}{V_p}\right)$$

In this calculation the angle is calculated positive in progressing along a left-turn circle. Because the full circle is surrounded during one period of the resonant frequency, the duration of that pulse can be calculated by:

$$t_p = \frac{\alpha_p}{\omega}$$

After reaching the desired system with the new current status the subsequent voltage level to be applied, equals the desired voltage, V. As there is no difference between the current system voltage state and the applied voltage, the system enters static conditions again. As above, in presence of un-negligible damping this time has to be adapted slightly.

For another voltage transition, the current system state is considered again as the starting point and the difference to the next system state has to be entered in the above calculation. All locus transitions follow left-turn circles, one has to observe, that target states are always reached by left turn progressions on the locus circle. If duration of the pulse turns out negative after the calculation, a full resonant period has to be added.

As one can further see, it will not be possible to realize a current change by this method without a voltage change, as the required pulse voltage will become infinite, if the target voltage is zero in the formula above, i.e. the initial and the final voltage are the same. In this case, the transition has to be split by one or more additional suitable intermediate levels. This principle is applied also, if it is required to limit the number of different voltages to few different values.

According to an exemplary embodiment, the waveform generator is adapted to produce a demagnetization sequence comprising of at least two different demagnetization voltage value steps. A last voltage value may equal zero or may have a voltage value slightly different from zero taking account of the ohmic resistance of the electric circuit. After this sequence, directly another pre-magnetization, magnetization and demagnetization sequence may succeed infinitely.

According to an exemplary embodiment, the waveform generator may generate double pulses with at least two consecutive pulses having the same voltage value. This means that the waveform generator may only generate two or three discrete voltage values with different pulse lengths, wherein the pulses may be divided from each other by gaps with zero voltage or another discrete voltage value. This embodiment may decrease the effort in creating the waveform generator, since a lesser number of voltage values is required and by adequate choice of the pulses the same characteristics as with consecutive pulses with different voltage values can be approximated.

According to an exemplary embodiment, the waveform generator comprises a set of adjustable DC voltage sources with voltage levels as determined by the reference pattern generator and a set of controlled semiconductor switches connecting the individual DC voltage sources with the pulse transformer during the time periods, as defined by the reference pattern generator. This setup increases the efficiency and reliability.

The need may also be met by an X-ray imaging system comprising an X-ray source supplied by a power supply unit according to the invention.

The need may also be met by a method for generating a high voltage as described in detail above.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION OF EMBODIMENTS

Figure 1:
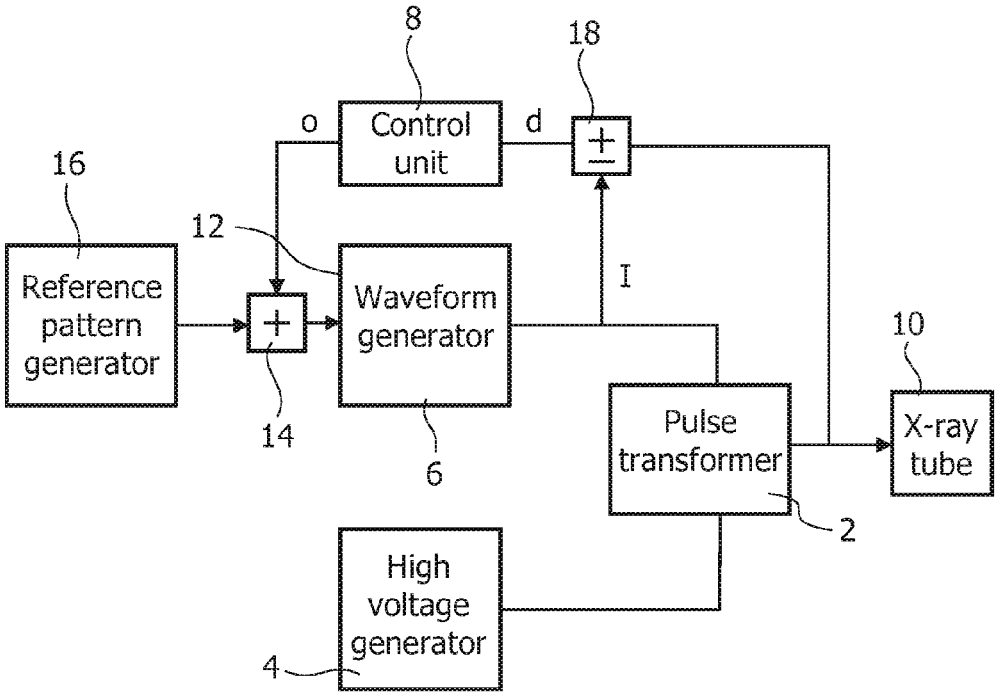
FIG. 1 illustrates an overall system architecture in a schematic drawing.

FIG. 1 shows the general system architecture including a pulse transformer 2, a high voltage generator 4, a waveform generator 6, a control unit 8, and an X-ray tube 10, being fed by a voltage coming from the pulse transformer 2. The waveform generator 6 has an input 12 which is connected to an adding block 14 which is fed by the control unit 8 and a reference pattern generator 16. The waveform generator converts the reference signal pattern at the input into a high power waveform at its output. The control unit 8 is fed by an error value d which is calculated by subtracting the measured current provided by the waveform generator 6 to the primary winding of the transformer from the measured current provided by the secondary side of the pulse transformer 2. This may be conducted by a subtraction block 18. Additionally, one or both of the measured currents may be multiplied by correction factor resulting from the winding ratio of the primary and secondary windings of the transformer.

Exemplarily, the control unit 8 is realized as a PID controller that may be tuned to the dynamic characteristics of the system.

Therefore, when an error value d is present, output 20 from the control unit 8 creates an offset value superposed to the reference pattern from the reference pattern generator 16 by the adding block 14 which supplies the result to the input 12 of the waveform generator 6.

In fact, when the x-ray-tube 10 is switched on, e.g. by means of internal grid-control, tube current will start and the initial current rise in the secondary winding of the transformer 2 will lead to an induced voltage across the secondary transformer terminals.

This voltage becomes apparent at the primary side, too. If the amplifier 6 is made of a voltage source type, the initial secondary current commutates to the primary side, producing a primary current which has the magnitude of the secondary current. This is precisely the amount of current required for prevention of saturation. However, once the secondary current has become constant, there will not be an induced voltage anymore which can keep up the primary current against the influence of resistive losses in the winding. In effect the primary current will decay. This will produce a difference in currents on both, primary and secondary side and results into saturation of the transformer. Subsequently the transformer 2 has low impedance and any attempt to apply a primary voltage in the direction of the saturated flux would lead to excessive current. To prevent this, the control unit 8 directly influences the signal being fed to the input 12 of the waveform generator, which balances out the currents on the primary winding and secondary winding so that the core of the transformer remains in the unsaturated state.

Since instantaneous changes of the secondary current translates by itself into appropriate currents on the primary side, only the decaying effects need to be eliminated which can be achieved by adapting the control unit 8 to the characteristic time constant of the current decay.

Therefore, the power supply unit as depicted in FIG. 1 provides an efficient way for reducing saturation effects so that the resulting voltage output for the X-ray tube always has the predetermined characteristics, therefore enabling a highly precise imaging process and a clearly lower risk of interference effects during the imaging operation of an X-ray system. The power supply unit allows a very fast switching from one high voltage level to another and also an undisturbed voltage output substantially independent from the X-ray tube operation.

Figure 2:
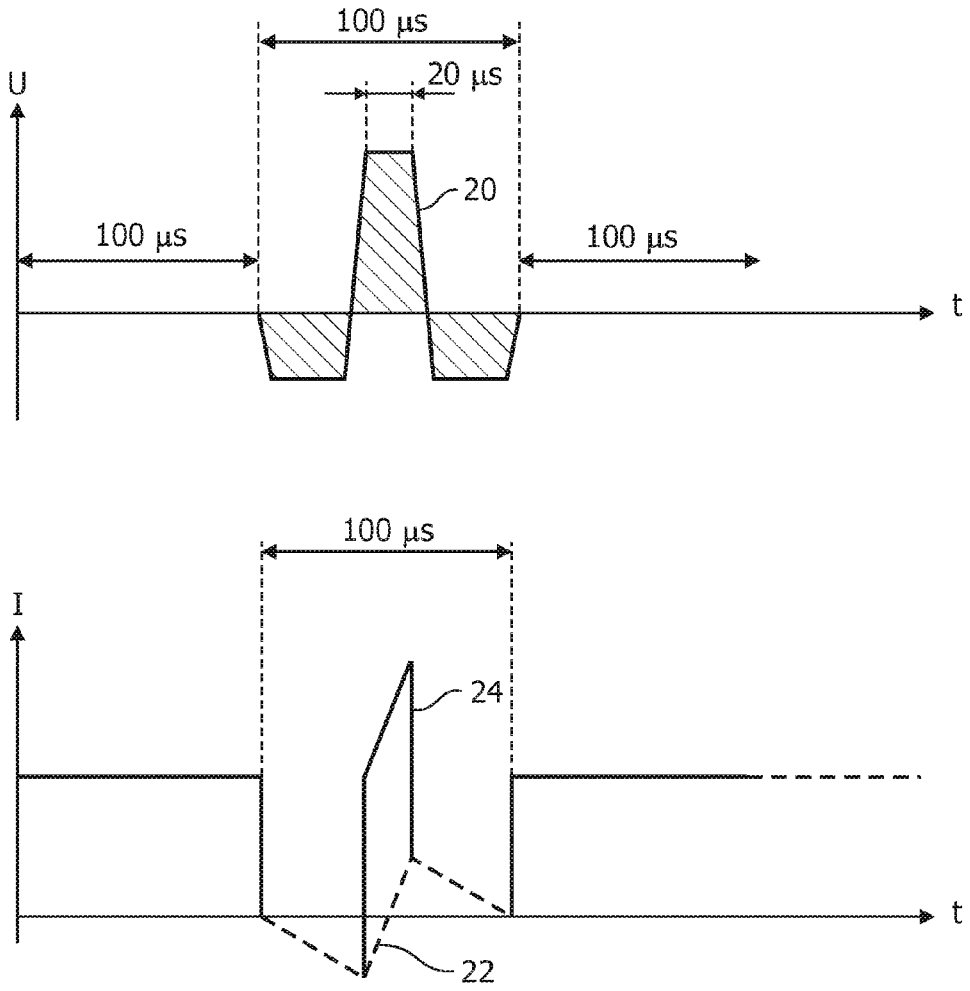
FIG. 2 shows principle voltage and current waveforms at the primary winding of the pulse transformer.

FIG. 2 shows in the top graph 20 a principle pattern of the waveform of the waveform generator with a timing cycle of 100 μs. If two voltages (e.g. 80 and 140 kV) are applied to an X-ray tube, then the system sensitivity is 5 times higher at 140 kV then at 80 kV. Normally, i.e. during constant voltage image acquisition, this is treated by reducing cathode heating and thus reducing the electron emission current in the X-ray tube. The temperature time constant of the cathode however is far slower than the time between two adjacent frames, so that the cathode emission will remain almost constant. Instead, by the space-charge effect, the emission current will be even slightly higher at 140 kV, than at 80 kV. Not to end up with over exposure, the amount of photons at a detector is therefore limited by gating the X-ray tube with a grid.

So eventually this results in a much shorter period in the order of 20 μs during a high voltage exposure, in which radiation is produced, while the full 100 μs cycle is used during a low voltage exposure. The exposure time of e.g. 20 μs should be situated the center of a time cycle.

The shown waveform is bipolar and symmetric, which means that there is at least one working pulse and pre- and demagnetization pulses with a voltage in opposite direction. The working pulse may be realized as a peak to a positive voltage, wherein the pre- and demagnetization pulses may be realized as two peaks to a negative voltage each, or vice-versa. By conducting a symmetric waveform with an integral that equals zero over the time of one complete period or timing cycle, the proper operation of the pulse transformer 2 can be accomplished due to the completion of a magnetic cycle. This means that the pulse transformer 2 can be operated at another magnetic cycle immediately and is therefore able to be operated substantially infinitely with the same waveform.

In the bottom graph of FIG. 2 there are shown a magnetizing current 22 and a primary transformer current 24 during the above described waveform pattern. The difference between these two curves is the resulting current of the X-ray tube (secondary current, with consideration of the turn ratio).

Figure 3A:
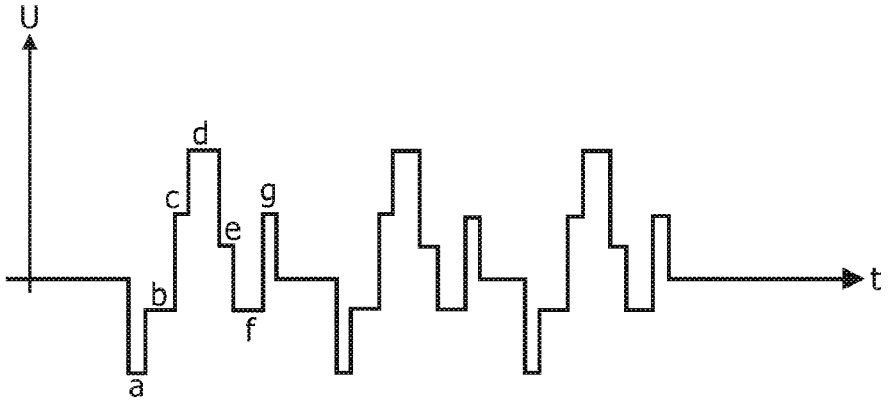
FIGS. 3*a* and 3*b* show detailed waveforms generated by a waveform generator with overshoot suppression.

FIG. 3*a* shows a detailed waveform generated by a reference pattern 16. Here, a multitude of positive and negative voltage peaks are generated and fed into the pulse transformer 2. One waveform period is shown as a sequence of seven different voltage levels succeeded by a gap with a zero voltage level. For a better understanding, the steps are named from (a) to (h). For simplicity, the waveform properties are denoted with positive and negative quantities, but it should be made clear that polarities are exchangeable and depend only on the scheme of wiring and desired direction of the superimposed pulses. In the following, the working pulse is considered to be positive, while the pre- and demagnetization pulses are negative:

a) is a negative voltage impulse in order to start pre-magnetization of the core of the pulse transformer 2 and stop the current in the pulse transformer, as the tube is typically switched off in this moment. The voltage level is chosen such that it produces a state transition at the secondary side of the transformer which ends at a secondary current of zero and a voltage resulting in pre-magnetizing of the transformer during the remaining time before the working pulse starts. This voltage is chosen such that the pre-magnetization will become equivalent to approximately half of the voltage-time integral of the working pulse When the desired transition is complete, the voltage rests for a certain period on a negative voltage level b) which is chosen such that it maintains the voltage achieved in period a). At the end of this period (just before the begin of the working pulse) the transformer has built up a negative magnetization, which is equivalent to approximately half of the voltage-time-integral of the working pulse. A further voltage impulse c) in is accomplished when the working pulse begins. The voltage of this step is adapted to trigger again a transition at the secondary side, which ends at a state with the desired tube current and the desired high voltage during the high voltage exposure.

After completion of the second transition a positive voltage pulse (d) is applied which keeps secondary voltage and current at the desired levels. During this magnetization of the transformer reverts from minus half the voltage-time-integral to plus half of the voltage-time-integral of the working pulse.

During phase e) a voltage is applied which again triggers a state transition, now to eliminate the secondary current again and cause a voltage transition down to the voltage which is needed to demagnetize the transformer completely until the end of the time frame.

After resting for a predetermined time at the voltage in phase f), which phase is needed to demagnetize the transformer, a short positive voltage impulse g) is accomplished and leaves the pulse transformer 2 in a neutral state with the secondary current again the desired tube current.

The step h) is at a zero voltage and can be as short or as long as desired. The integral over a complete time cycle equals zero. During this state typically the lower voltage applies to the x-ray tube and the tube current remains flowing for an arbitrary long single or sequence of exposures. The length of this period can be made zero, if a second high voltage pulse cycle is required immediately after the first one.

Figure 3B:
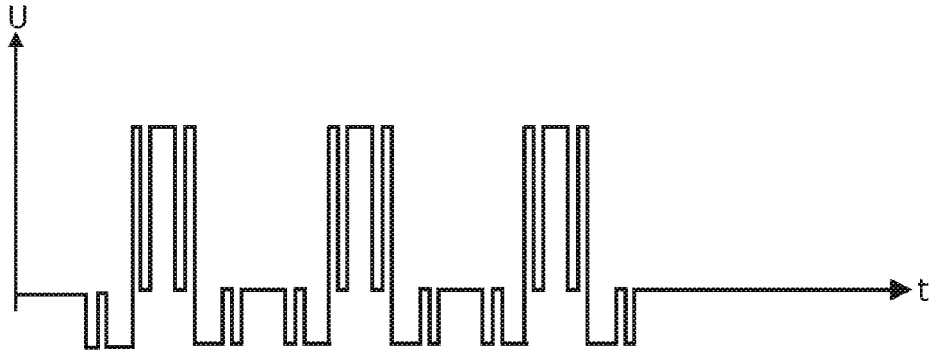

FIG. 3*b* shows an alternative pulse sequence in form of double pulses. There, the effect of the above described pulse sequence is achieved by a number of discrete positive and negative pulses with a reduced number of different levels.

Figure 4A:
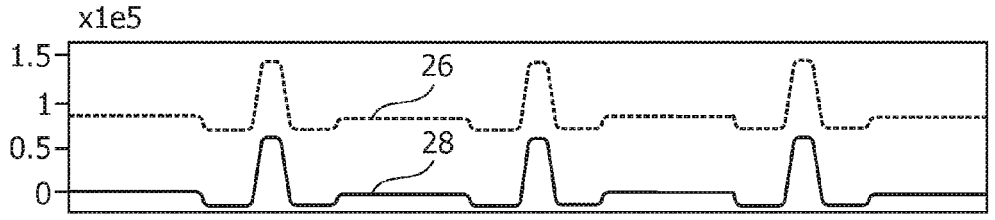
FIGS. 4*a* to 4*c* show current and voltage graphs of pulse transformer and an X-ray tube supplied by the power supply unit according to the invention.
Figure 4B:
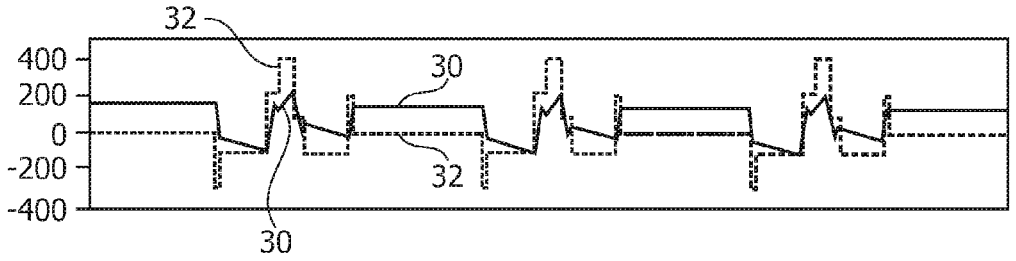

FIG. 4*a* shows a provided tube voltage 26 over the transformer secondary voltage 28. It can be seen, that the accelerating voltage of the tube follows a smooth transition without any overshoot behaviour. The potential saturation due to the emission current is compensated by a DC current on the primary side of the transformer.

The waveform generator follows a much more complicated pattern which has precisely to be adapted to the system parameters total leakage, tube head capacitance, including any cables, and grid switching pattern. FIG. 4*a* shows the voltage curve 32 for the primary of the pulse transformer 2 and the relating current curve 30. It can be seen that using the pulse pattern shown in FIG. 3*a* highly reduces the risk of an overshooting primary current as can be seen in the transition between the current caused by steps c) and d), where the current curve has a small peak in the amplitude. By using a two-step-magnetization pulse sequence with pulses c) and d) the overshoot of current 30 and voltage 26 can be clearly eliminated.

Figure 4C:
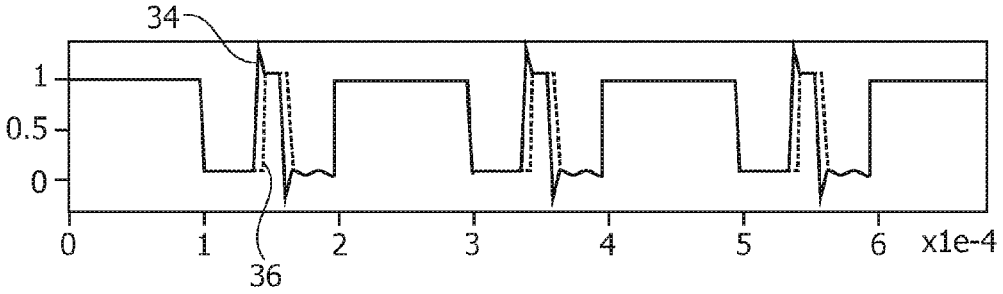

FIG. 4*c* shows the resulting tube current 36 and the transformer secondary current 34 that is adjusted to rapidly increase the tube current 36 during the magnetization steps without an overshoot of the tube current 36.

Figure 5:
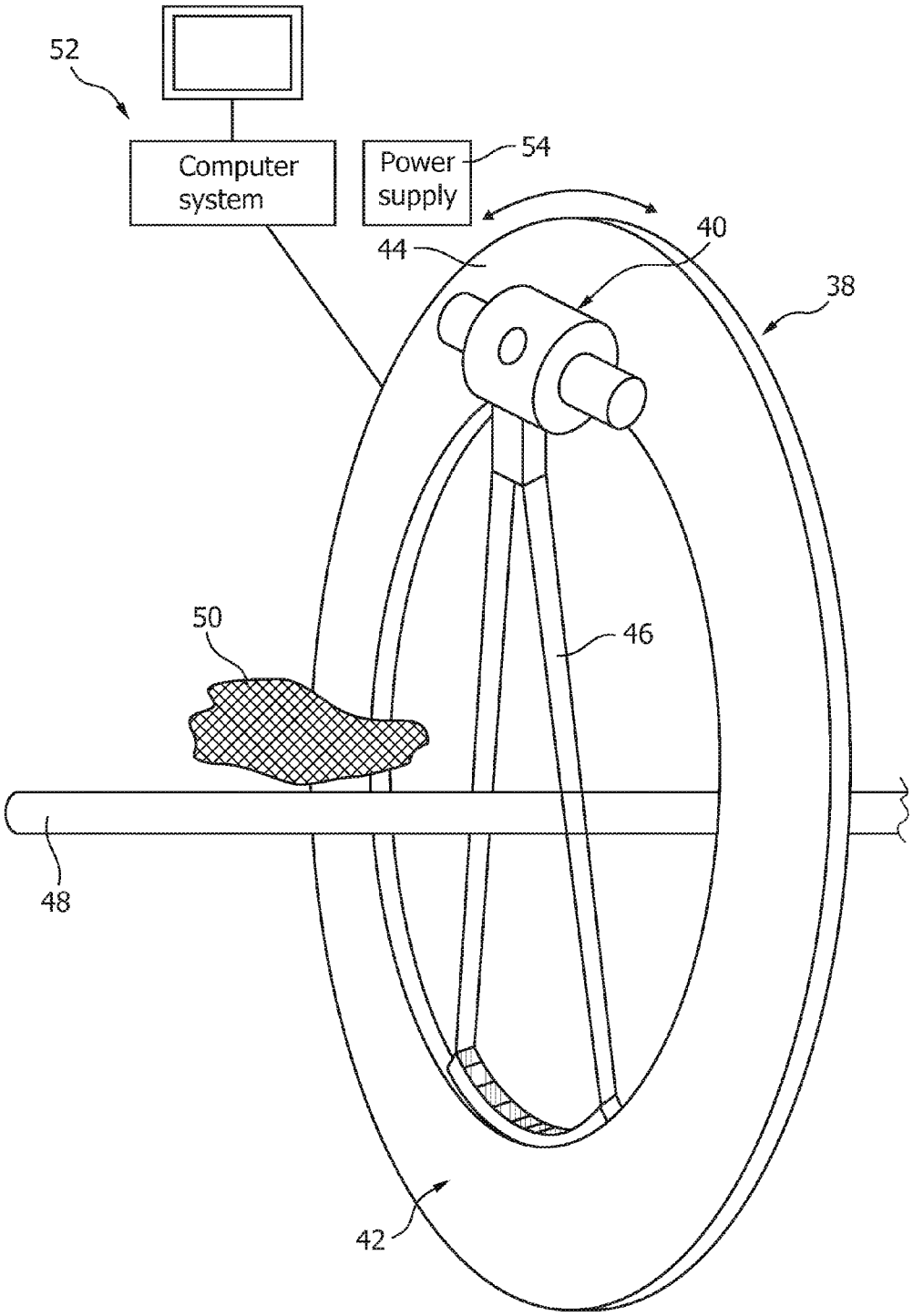
FIG. 5 shows an X-ray imaging system provided with a power supply according to the invention.

Finally, FIG. 5 shows an exemplary embodiment of an X-ray imaging system according to the present invention. The X-ray imaging system 38 of comprises an X-ray generating device 40 as well as an X-ray detector 42, here exemplary depicted as a line array. Both, the X-ray generating device 40 and the X-ray detector 42 are mounted on gantry 44, opposing one another. X-radiation 46 is emanating from X-ray generating device 40 in the direction of X-ray detector 42. Situated on a support 48, an object 50 is arranged in the path of X-rays 46. The gantry 44 comprising the X-ray generating device 40 and the X-ray detector 42 may be rotated about object 50, e.g. a patient, for the acquisition of X-ray images. A computer system 52 is provided for controlling the X-ray imaging system 38 and/or for evaluating acquired X-ray images. The X-ray generating device 40 is connected to a power supply 54 according to the present invention, allowing a fast switching between two different voltage values enabling the X-ray imaging system 38 for providing more precise data about the composition of the object 50 to be examined.

Figure 6:
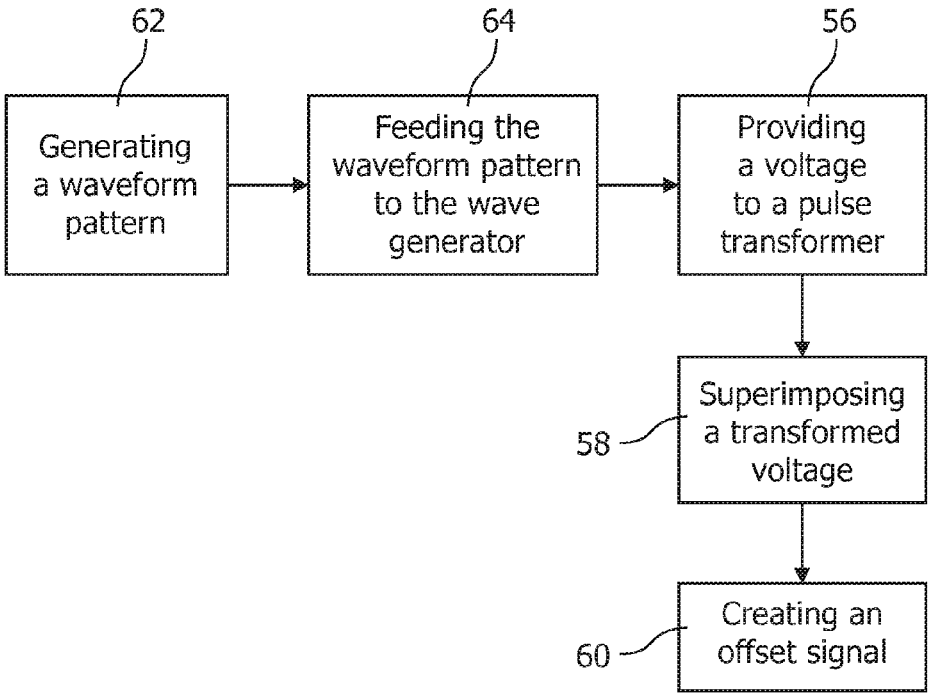
FIG. 6 shows a block diagram of the method according to the invention.

FIG. 6 shows a method for generating a high voltage for supplying an X-ray tube according to the invention. As described in detail above, the method basically comprises the steps of providing 56 a voltage to a pulse transformer by means of a wave generator, superposing 58 a transformed voltage from the waveform generator onto the voltage provided by a high voltage generator and creating 60 an offset signal depending on a difference between a current in primary windings and the current in secondary windings of the pulse transformer by means of a control unit in order to counteract saturation effects of the pulse transformer. Further, the method according to the invention may comprise the steps of generating 62 a waveform pattern by means of a reference pattern generator and feeding 64 the waveform pattern to the wave generator, wherein the waveform pattern comprises a plurality of pulses for pre-magnetizing, magnetizing and demagnetizing the pulse transformer as described above.

Figure 7:
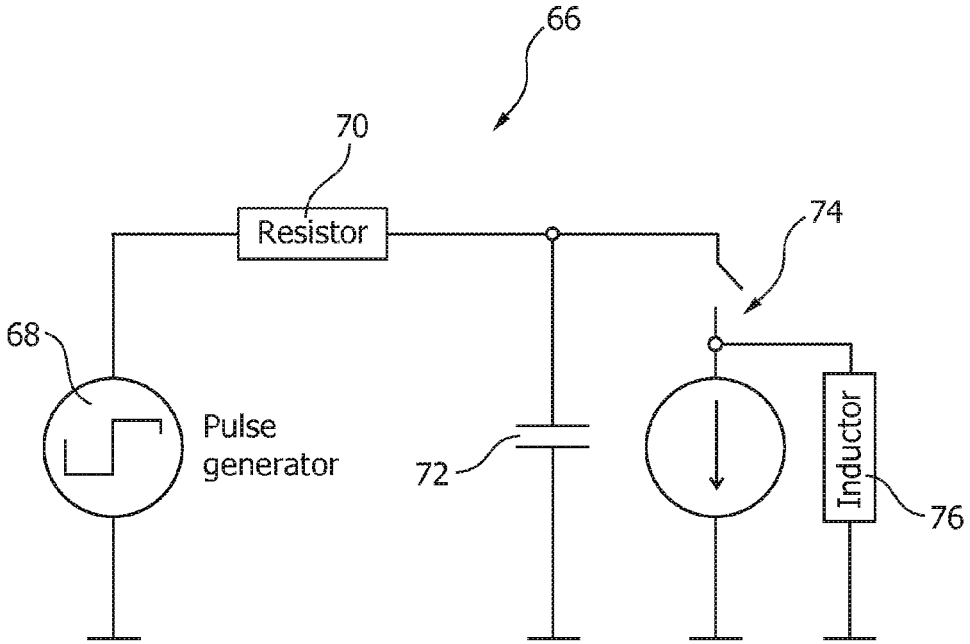
FIG. 7 shows an equivalent electric circuit for the dynamic behavior of the power supply unit.

Finally, FIG. 7 shows an equivalent electric circuit 66 of the power supply unit according to the invention, comprising a pulse generator 68, an ohmic resistor 70 representing the total leakage, a capacity 72 representing the cathode head and cable capacitance, a grid switch 74 and an inductor 76, representing the transconductance of the tube. This figure illustrates the dynamic behavior of the circuit and thus does not contain the constant part of the high voltage of high voltage generator 4.

LIST OF REFERENCE SIGNS

2 pulse transformer
4 high voltage generator
6 waveform generator
8 control unit
10 X-ray tube
12 input
14 adding block
16 reference pattern generator
18 subtraction block
20 waveform graph
22 magnetizing current
24 secondary transformer current
26 tube voltage
28 secondary transformer voltage
30 primary transformer current
32 primary transformer voltage
34 secondary transformer current
36 tube current
38 X-ray imaging system
40 X-ray generating device (X-ray tube)
42 X-ray detector
44 gantry
46 X-radiation
48 support
50 object
52 computer system
54 power supply
56 providing a voltage to pulse transformer
58 superposing the transformed voltage
60 creating an offset signal
62 generating a waveform pattern
64 feeding the waveform pattern to wave generator
66 electric circuit
68 pulse generator
70 ohmic resistor
72 capacity
74 grid switch

The invention claimed is:

1. A power supply unit for an X-ray radiation source, comprising:

a high voltage generator, a waveform generator, a pulse transformer, and a control unit, wherein the waveform generator is adapted for providing a voltage to the pulse transformer, wherein the pulse transformer is adapted for superposing a transformed voltage from the waveform generator onto the voltage provided by the high voltage generator and wherein the control unit is adapted for creating an offset signal (o) depending on the difference (d) between the current in primary windings and the current in secondary windings of the pulse transformer and for feeding the offset signal (o) to an input of the waveform generator to counteract saturation effects of the pulse transformer.

2. The power supply unit according to claim 1, further comprising a reference pattern generator connected to the input of the waveform generator, wherein the reference pattern generator is adapted for providing a waveform with a desired pattern to the waveform generator.

3. The power supply unit according to claim 2, wherein the reference pattern generator is adapted for providing a pulse pattern with voltage values above and below zero, wherein the integral over time equals zero over each pulse pattern period.

4. The power supply unit according to claim 2, wherein the reference pattern generator is adapted for providing a pulse pattern with a first time interval and with at least one working pulse of a given polarity followed by at least one pulse with opposite polarity.

5. The power supply unit according to claim 4, wherein the working pulse is realized as a voltage of a given polarity with a certain magnetization pulse length leading to the desired peak voltage output for a desired length.

6. The power supply unit according to claim 5, wherein the working pulse length is less than half of a frame time window.

7. The power supply unit according to claim 5, wherein the working pulse is realized in form of at least two magnetization pulse steps with different voltage values.

8. The power supply unit according to claim 5, wherein the waveform generator is adapted for providing at least a second magnetization voltage step with a voltage value step depending on the resonant frequency and the characteristic impedance of a circuit comprising the power supply unit and an X-ray tube.

9. The power supply unit according to claim 5, wherein the waveform generator is adapted to produce a demagnetization sequence comprising of at least one demagnetization voltage value step depending on the resonant frequency and the characteristic impedance of a circuit with the power supply unit and an X-ray tube.

10. The power supply unit according to claim 5, wherein the waveform generator is adapted for generating double pulses with the same voltage level.

11. The power supply unit according to claim 5, wherein the reference pattern generator is adapted to produce several voltage pulses at a cathode of an X-ray tube during a single frame time window.

12. The power supply unit according to claim 2, wherein the pulse pattern comprises a pre-magnetization pulse for bringing the magnetization to approximately half of the opposite of the value due to the working pulse alone.

13. The power supply unit according to claim 2, wherein the waveform generator comprises a set of adjustable DC voltage sources with voltage levels as determined by the reference pattern generator and a set of controlled semiconductor switches connecting the individual DC voltage sources with the pulse transformer during the time periods, as defined by the reference pattern generator.

14. An X-ray imaging system, comprising an X-ray tube and a power supply unit according to claim 1 to supply the X-ray tube.

15. A method for generating different high output voltage levels, comprising the steps providing a voltage to a pulse transformer by means of a waveform generator;

superposing a transformed voltage from the waveform generator onto the voltage provided by a high voltage generator;

creating an offset signal (o) depending on a difference d between a current in primary windings and the current in secondary windings of the pulse transformer by means of a control unit and feeding the offset signal (o) to an input of the waveform generator in order to counteract saturation effects of the pulse transformer.

16. The method according to claim 15, further comprising the steps of generating a waveform pattern by means of a reference pattern generator and feeding the waveform pattern to the waveform generator, wherein the waveform pattern comprises a plurality of pulses for pre-magnetizing, magnetizing and demagnetizing the pulse transformer.

* * * * *